US011591697B2

(12) United States Patent
Rydkin et al.

(10) Patent No.: US 11,591,697 B2
(45) Date of Patent: Feb. 28, 2023

(54) CORROSION PROTECTION SYSTEM FOR HEATING VENTALATION AIR CONDITIONING REFRIGERATION

(71) Applicant: Carrier Corporation, Palm Beach Gardens, FL (US)

(72) Inventors: Ivan Rydkin, Rochester, NY (US); Jeffrey Quesnel, Brewerton, NY (US); Kerry Allahar, Syracuse, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 402 days.

(21) Appl. No.: 16/644,221

(22) PCT Filed: Sep. 5, 2018

(86) PCT No.: PCT/US2018/049496
§ 371 (c)(1),
(2) Date: Mar. 4, 2020

(87) PCT Pub. No.: WO2019/050911
PCT Pub. Date: Mar. 14, 2019

(65) Prior Publication Data

US 2020/0199765 A1 Jun. 25, 2020

Related U.S. Application Data

(60) Provisional application No. 62/555,360, filed on Sep. 7, 2017.

(51) Int. Cl.
*F24F 11/30* (2018.01)
*C23F 13/00* (2006.01)
(Continued)

(52) U.S. Cl.
CPC ..... *C23F 13/00* (2013.01); *F24F 11/30* (2018.01); *C23F 13/04* (2013.01);
(Continued)

(58) Field of Classification Search
CPC .. C23F 13/02–13/22; C23F 2213/00–2213/32; C23F 13/005; F24F 11/30
See application file for complete search history.

(56) References Cited

U.S. PATENT DOCUMENTS 4,219,807 A 8/1980 Beil et al.
4,630,221 A 12/1986 Heckenbach et al.
(Continued)

FOREIGN PATENT DOCUMENTS

CN 201514391 U * 6/2010
CN 201514391 U 6/2010
(Continued)

OTHER PUBLICATIONS

Qi et al. ("A Review of Different Sensors Applied to Corrosion Detection and Monitoring", Recent Patents on Corrosion Science, 2011, 1, pp. 1-7). (Year: 2011).*
(Continued)

*Primary Examiner* — Alexander W Keeling
(74) *Attorney, Agent, or Firm* — Cantor Colburn LLP

(57) ABSTRACT

A corrosion protection system is provided. The corrosion protection system comprises an electrical contact coupled to an apparatus. The electrical contact can apply a negative potential to the apparatus. The corrosion protection system comprises a sensor. The sensor detects moisture with respect to the apparatus. The corrosion protection system comprises a power supply. The power supply is electrically coupled to the electrical contact and provides a negative potential to the electrical contact in accordance with commands of a processor. The processor utilizes the power supply attached to the apparatus via the electrical contact to provide and apply the negative potential to the apparatus based on a sensor signal from the sensor. The sensor signal indicates the detection of the moisture by the sensor.

20 Claims, 3 Drawing Sheets

(51) Int. Cl.
*F24F 110/20* (2018.01)
*C23F 13/04* (2006.01)

(52) U.S. Cl.
CPC ..... *C23F 2213/10* (2013.01); *C23F 2213/32* (2013.01); *F24F 2110/20* (2018.01)

(56) References Cited

U.S. PATENT DOCUMENTS

| | | | |
|---|---|---|---|
| 4,869,874 | A | 9/1989 | Falat |
| 5,366,604 | A | 11/1994 | Stilley |
| H1644 | H | 5/1997 | Muehl, Sr. |
| 6,469,918 | B1 | 10/2002 | Abramski |
| 7,264,708 | B2 | 9/2007 | Whitmore et al. |
| 8,968,549 | B2 | 3/2015 | Sergi et al. |
| 9,005,423 | B2 | 4/2015 | Cahill-O'Brien |
| 2006/0231416 | A1 | 10/2006 | Maeuser |
| 2007/0023295 | A1 | 2/2007 | Dowling |
| 2014/0202879 | A1 | 7/2014 | Bennett |
| 2017/0089828 | A1 | 3/2017 | Allahar et al. |
| 2017/0121828 | A1 | 5/2017 | Simpson et al. |
| 2017/0130341 | A1 | 5/2017 | Suzuki et al. |

FOREIGN PATENT DOCUMENTS

| | | | | |
|---|---|---|---|---|
| JP | H0874077 | A | | 3/1996 |
| KR | 20080060858 | A | * | 12/2006 |
| WO | WO-9311279 | A1 | * | 6/1993 ..... C23F 13/04 |
| WO | 2016103445 | A1 | | 6/2016 |

OTHER PUBLICATIONS

Anis et al., "Photovoltaic-powered regulated cathodic-protection system," Journal of Power Sources, 1994, p. 27-32, vol. 50, Issue 1.
El-Alem et al., "Design of a Cathodic Protection System To Prevent Corrosion of Metallic Structures Using Hybrid Renewable Energy Sources," Engineering Research Journal: Faculty of Engineering Minoufiya University, Apr. 2013, p. 109-117, vol. 36, No. 2.
Eur Ing R. L. Kean et al., "Cathodic Protection," National Physical Laboratory, Publication Date UNK, 8 pages.
Huck, Ted, "Cathodic Protection for Above Ground Storage Tanks," WaterWorld, Retrieved from: http://www.waterworld.com/articles/print/volume-25/issue-3/editorial-feature/cathodic-protection-for-above-ground-storage-tanks, html, vol. 25, Issue 3, 7 pages.
International Search Report and Written Opinion for application PCT/US2018/049496, dated Nov. 23, 2018, 14 pages.
Shankar et al., "Solar Powered Corrosion Prevention in Iron Pipelines using Impressed Current Cathodic Protection," 2014, 14th International Conference on Environment and Electrical Engineering, May 10-12, 2014, 6 pages.
European Search Report for Application No. 18773705.1; dated May 20, 2022; 5 Pages.

* cited by examiner

CORROSION PROTECTION SYSTEM FOR HEATING VENTALATION AIR CONDITIONING REFRIGERATION

BACKGROUND

Generally, corrosion is a degradation of metal caused by a reaction with an environment, such as an oxidation of and/or a chemical attack on a material surface of the metal. Copper, for example, is susceptible to attack from sulfur-containing gases. The reaction with the environment can also cause formations of nonprotective layers on the material surface. Further, unprotected metals continue to react with contaminants and corrode. When left unchecked and under prolonged conditions, continuous corrosion can jeopardize the integrity of the metal.

Accordingly, there exists a need for a corrosion protection system that can monitor, detect, address, and/or prevent corrosion.

BRIEF DESCRIPTION

In accordance with one or more embodiments, a corrosion protection system is provided. The corrosion protection system comprises an electrical contact coupled to an apparatus and configured to apply a negative potential to the apparatus; a sensor detecting moisture with respect to the apparatus; a power supply electrically coupled to the electrical contact and configured to provide a negative potential to the electrical contact in accordance with commands of a processor; and the processor utilizing the power supply attached to the apparatus via the electrical contact to provide and apply the negative potential to the apparatus based on a sensor signal from the sensor, the sensor signal indicating the detection of the moisture by the sensor.

In accordance with one or more embodiments or the corrosion protection system embodiment above, the negative potential can comprise a potential that is more negative than if no potential is being applied, and the negative potential can mitigate, stop, or prevent corrosion of the apparatus when applied.

In accordance with one or more embodiments or any of the corrosion protection system embodiments above, the electrical contact can be coupled to a metallic component or portion thereof of the apparatus that is exposed to the moisture.

In accordance with one or more embodiments or any of the corrosion protection system embodiments above, the metallic component or portion thereof can be selected from at least one member of a group consisting of tube header joints, rails of a box or container unit, and micro channel heat exchanger coils.

In accordance with one or more embodiments or any of the corrosion protection system embodiments above, the sensor can comprise a corrosion sensor comprising a cathodic metallic layer and an anodic metallic layer, and the cathodic metallic layer can be configured to allow the moisture to pass therethrough.

In accordance with one or more embodiments or any of the corrosion protection system embodiments above, the electrical contact can comprise two electrodes completing a circuit with a metal of the apparatus as a connecting resistor.

In accordance with one or more embodiments or any of the corrosion protection system embodiments above, the processor can determine the negative potential required to mitigate corrosion due to the moisture.

In accordance with one or more embodiments or any of the corrosion protection system embodiments above, the processor can regulate a direct current voltage from the power supply along range from 50 to 100 millivolts.

In accordance with one or more embodiments or any of the corrosion protection system embodiments above, the corrosion protection system can comprise a sensor feedback loop that continuously checks a status of the apparatus by polling the sensor and applying the negative potential via the electrical contact until a corrosion threat is gone.

In accordance with one or more embodiments or any of the corrosion protection system embodiments above, the sensor can comprise a corrosion sensor, the corrosion protection system can comprise: one or more electrodes including the electrical contact; one or more sensors including the corrosion sensor; and a controller that comprises: a multiplexer that provides the negative potential from the power supply to the one or more electrodes; the power supply; and the processor applying one or more select signals to the multiplexer.

In accordance with one or more embodiments or any of the corrosion protection system embodiments above, the corrosion protection system can comprise a plurality of electrodes that include the electrical contact, each of the plurality of electrodes establishing a zone within the apparatus.

In accordance with one or more embodiments, a corrosion protection method is provided. The corrosion protection method comprises applying, by an electrical contact coupled to an apparatus, a negative potential to the apparatus; detecting, by a sensor, moisture with respect to the apparatus; providing, by a power supply electrically coupled to the electrical contact, a negative potential to the electrical contact in accordance with commands of a processor; and utilizing, by the processor, the power supply attached to the apparatus via the electrical contact to provide and apply the negative potential to the apparatus based on a sensor signal from the sensor, the sensor signal indicating the detection of the moisture by the sensor.

In accordance with one or more embodiments or the corrosion protection method embodiment above, the negative potential can comprise a potential that is more negative than if no potential is being applied, and the negative potential mitigates, stops, or prevents corrosion of the apparatus when applied.

In accordance with one or more embodiments or any of the corrosion protection method embodiments above, the electrical contact can be coupled to a metallic component or portion thereof of the apparatus that is exposed to the moisture.

In accordance with one or more embodiments or any of the corrosion protection method embodiments above, the sensor can comprise a corrosion sensor comprising a cathodic metallic layer and an anodic metallic layer, and the cathodic metallic layer can be configured to allow the moisture to pass therethrough.

In accordance with one or more embodiments or any of the corrosion protection method embodiments above, the electrical contact can comprise two electrodes completing a circuit with a metal of the apparatus as a connecting resistor.

In accordance with one or more embodiments or any of the corrosion protection method embodiments above, the processor can determine the negative potential required to mitigate corrosion due to the moisture.

In accordance with one or more embodiments or any of the corrosion protection method embodiments above, the processor can regulate a direct current voltage from the power supply along range from 50 to 100 millivolts.

In accordance with one or more embodiments or any of the corrosion protection method embodiments above, the corrosion protection system can comprise a sensor feedback loop that continuously checks a status of the apparatus by polling the sensor and applying the negative potential via the electrical contact until a corrosion threat is gone.

In accordance with one or more embodiments or any of the corrosion protection method embodiments above, the corrosion protection method can comprise providing, via a multiplexer of a controller, the negative potential from the power supply to one or more electrodes, the one or more electrodes including the electrical contact; and applying, by the processor, one or more select signals to the multiplexer.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Embodiments herein relate to a corrosion protection system, method, and/or computer program product (herein collectively referred to as corrosion protection system). The corrosion protection system comprises a power source that provides potential to metal of heating ventilation air conditioning refrigeration (HVACR) equipment. HVACR equipment can be found with respect to coastal coils, integrated container boxes, equipment located near contaminated environments (e.g., near factories, restaurants, roads, etc.). The metal can be any metallic component or portion thereof of the HVACR equipment that is exposed to moisture. The potential is such that it is more negative than if no potential is being applied; i.e., the 'negative' potential mitigates, stops, and/or prevents corrosion of the metal.

Figure 1:
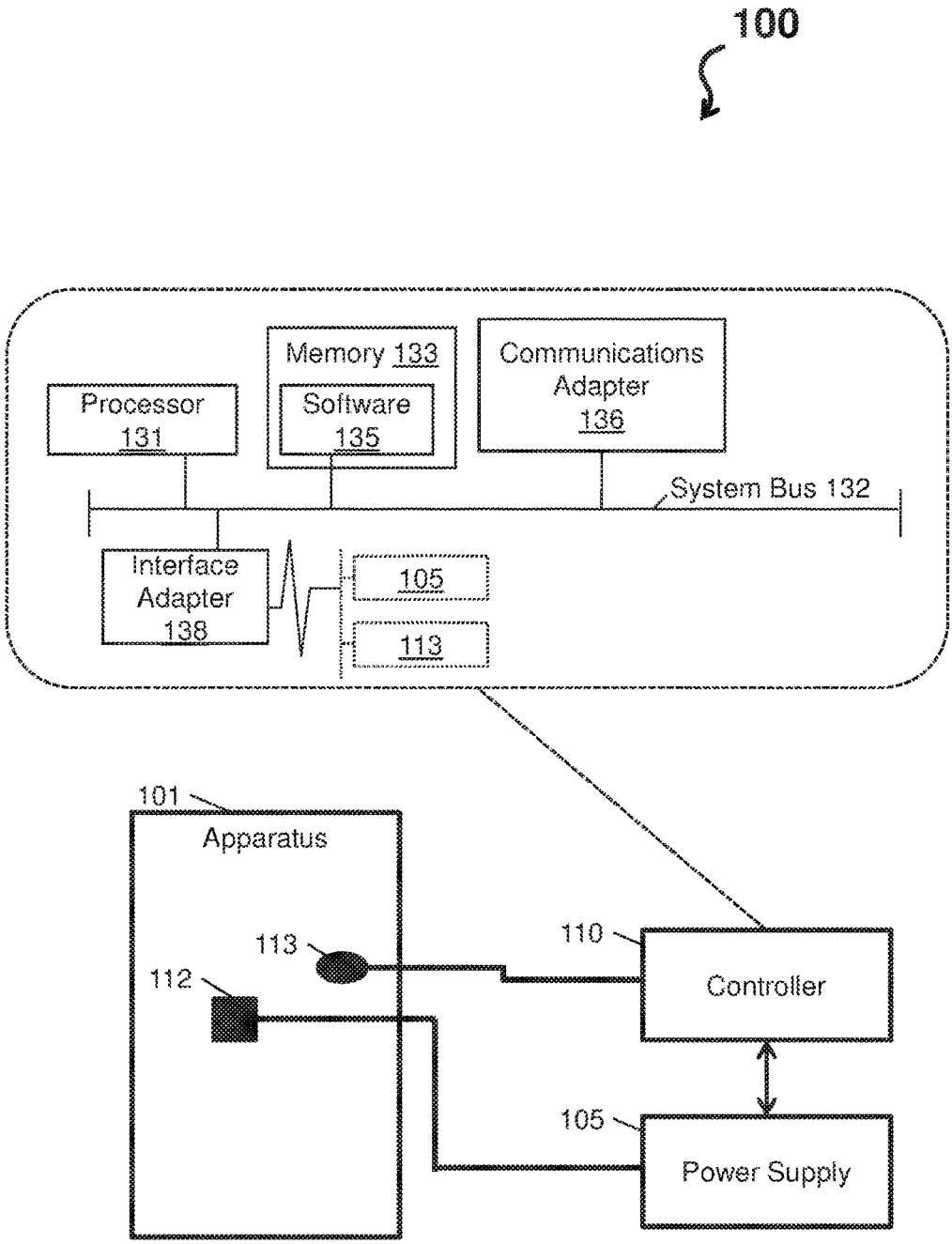
FIG. 1 depicts a corrosion protection system in accordance with one or more embodiments.

Turning now to FIG. 1, a corrosion protection system 100 is depicted in accordance with one or more embodiments. As depicted, the corrosion protection system 100 comprises an apparatus 101, a power supply 105, a controller 110, an electrical contact 112, and a sensor 113. In accordance with one or more embodiments, the corrosion protection system 100 utilizes the power supply 105 attached to the apparatus 101 to draw power and provide constant voltage across the apparatus 101 (even when the apparatus 101 is not operating). The technical effects and benefits of the corrosion protection system 100 can comprise continuous corrosion protection that can prolong the useful life of the HVAC equipment by reducing or eliminating the effect(s) of corrosion. Accordingly, the corrosion protection system 100 can reduce the need for specialty coatings on metal components (e.g., heat exchange coils) or stainless internal components (e.g., piping, valves, sensors, and the like).

The apparatus 101 can be any component, appliance, or machinery of HVACR equipment. Examples of the apparatus 101 can include, but are not limited thereto, chiller, air conditioning unit, heat pump, fan coils, tube header joints, base rails of a box/container unit (e.g., residential or transport system), and sections of micro channel heat exchanger coils.

The power supply 105 can be any electrical power source capable of supplying the negative potential. The power supply 105 can be a direct current (DC) power supply. Example of the power supply 105 can include, but are not limited to, a hard wiring to an electrical grid, solar powered equipment, and/or a battery itself (e.g., electrical storage system batteries plus controllers and inverters). The electrical contact 112 can comprise two electrodes capable of completing a circuit with the metal of the apparatus 101 as a connecting resistor. In this way, as the negative potential is delivered by the power supply 105 to the electrical contact 112, a current is generated that prevents or counteracts corrosion. Note that, in accordance with one or more embodiments, the protection can occur in the presence of an electrolyte, such as a thin film of condensate or salt water, on the surface of the metal of the apparatus 101.

The sensor 113 can be any electro-mechanical component that detects events or changes with respect to the apparatus 101 of the corrosion protection system 100 (or corresponding components therein). In general, the sensor 113 can be a wet dry meter that detects when a metal of the apparatus 101 is wet. The sensor 113 can be co-located at a representative site of the metal of the apparatus 101. That is, the sensor 113 is configured to be placed on or near exposed metallic component or portion thereof of the HVACR equipment, such as outdoor HVAC units to monitor and estimate a corrosive impact of weather on the HVAC units. A geometry of sensor 113 can be similar to a geometry of the representative site, i.e., micro channel heat exchanger coils may require a rounded geometry for the sensor 113. Examples of the sensor 113 can include, but are not limited to, humidity sensors, temperature sensors, and corrosion sensors. In accordance with one or more embodiments, a humidity sensor and a surface temperature sensor can be utilized to discern through logic whether the metal of the apparatus 101 is wet. The sensor 113 can output the events or changes as sensor signals to other components of the corrosion protection system 100 (e.g., the controller 110). Note that while one sensor 113 is shown, different embodiments can include a plurality sensors 113 as required by the corrosion protection system 100.

In accordance with one or more embodiments, the corrosion sensor can include a cathodic metallic layer and an anodic metallic layer disposed within a housing. The housing can be configured to have an opening located adjacent to the cathodic metallic layer to allow moisture to pass therethrough. The cathodic metallic layer can be configured to allow moisture to pass therethrough. In some embodiments, the perimeter of the housing is sealed. It will be appreciated that the perimeter of the housing may be sealed by any material suitable to create a water-tight seal around the perimeter. The cathodic metallic layer can be positioned and affixed to the anodic metallic layer via an epoxy, such that an air gap is created therebetween. The air gap can house a cotton gauze material, or other suitable materials, that separates the cathodic and anodic metallic surfaces. For example, in operation, the cathodic metallic layer is exposed to the environment such that moisture may enter the corrosion sensor and pass through the cathodic metallic layer, wet the cotton gauze, and come into contact with the anodic metallic layer.

In accordance with one or more embodiments, the corrosion sensor can further include a data logger operably coupled to the cathodic metallic layer and the anodic metallic layer. The data logger can be chosen from a group comprising a current data logger and a voltage data logger. For example, a current data logger is configured to determine a corrosion level based at least in part on a measured galvanic current flowing from the cathodic metallic layer through the anodic metallic layer. A voltage data logger is configured to determine a corrosion level based at least in part on a measured galvanic potential between the cathodic metallic layer and the anodic metallic layer. The data logger may include a communication module disposed therein to transmit the corrosion level, the measured galvanic current, and/or the measured galvanic potential to the controller 110.

The controller 110 operates at least the power supply 105 (and in turn the electrical contact 112) in accordance with sensor signals from the sensor 113. The controller 110 can comprise one or more central processing units (CPU(s)) (collectively or generically referred to as a processor 131). The processor 131, also referred to as a processing circuit, is coupled via a system bus 132 to a memory 133 and various other components. The memory 133 can include a read only memory (ROM) and a random access memory (RAM). The ROM can be coupled to the system bus 132 and may include a basic input/output system (BIOS), which controls certain basic functions of the controller 110. The RAM can be read-write memory coupled to the system bus 132 for use by the processor 131. A software 135 for execution on the controller 110 may be stored in the memory 133. In accordance with one or more embodiments, the software 135 can include instructions to implement an application of the potential by the power supply 105 to the apparatus 101 as the sensor signals from the sensor 113 indicate moisture or the potential thereof (e.g., when the measured galvanic current/potential exceeds a predetermined limit) and instructions to implement/transmit an alert signal when moisture is present. The memory 133 is an example of a tangible storage medium readable by the processor 131, where the software 135 is stored as instructions for execution by the processor 131 to cause the corrosion protection system 100 to operate as described herein. Examples of computer program product and the execution of such instruction is discussed herein in more detail.

The controller 110 can further comprise a communications adapter 136 and an interface adapter 138 coupled to the system bus 132. The communications adapter 136 can interconnect the system bus 132 with a network, which may be an outside network, enabling the corrosion protection system 100 to communicate with other systems. The interface adapter 138 can interconnect and integrated multiple devices with the controller 110, such as the power supply 105 and the sensor 113.

Figure 2:
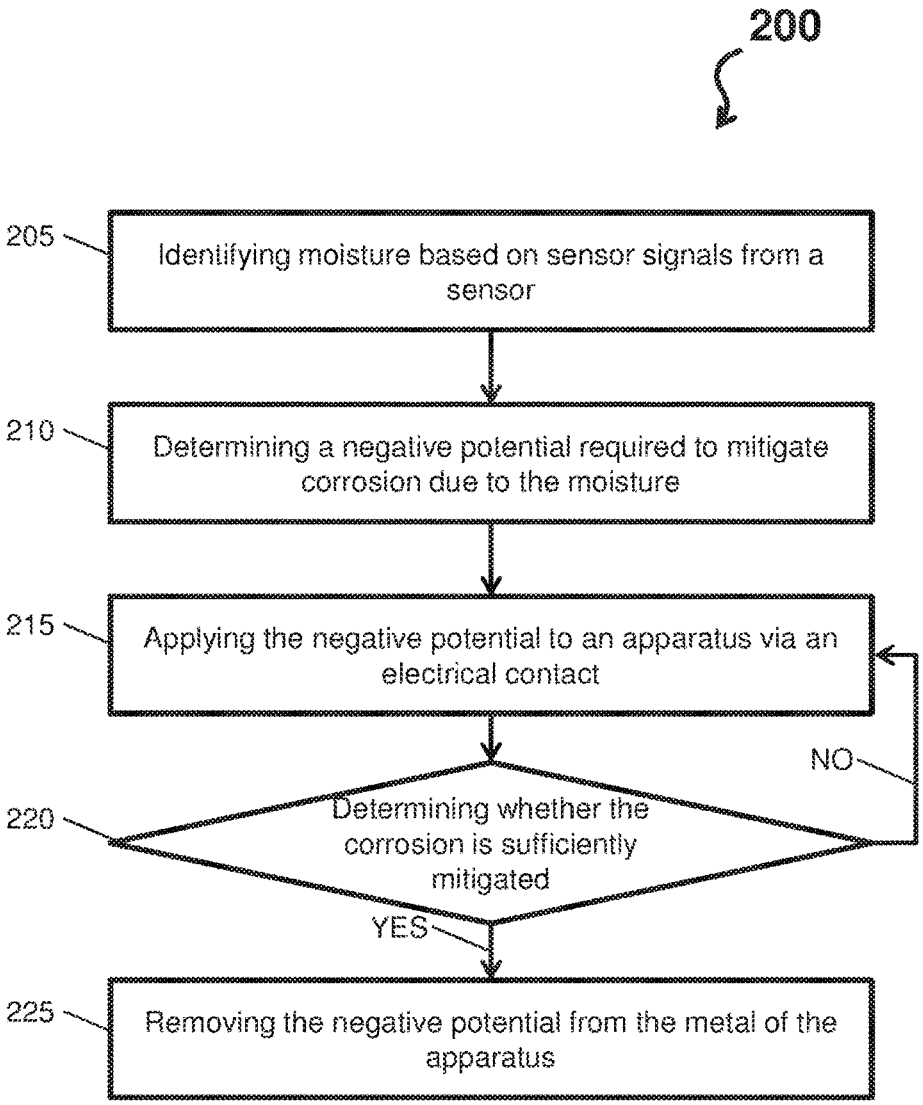
FIG. 2 depicts a corrosion protection process flow in accordance with one or more embodiments.

Turning now to FIG. 2, a corrosion protection process flow 200 is depicted in accordance with one or more embodiments. The corrosion protection process flow 200 begins at block 205, where the controller 110 identifies moisture based on sensor signals from the sensor 113.

At block 210, the controller 110 determines a negative potential required to mitigate corrosion due to the moisture. The negative potential can comprise regulating DC voltage from the power supply 105 along range from 50 to 100 millivolts, but not limited to this range.

At block 215, the controller 110 causes/commands the power supply 105 to apply the negative potential to the apparatus via the electrical contact 112.

At decision block 220, the controller 110 determines whether the corrosion is sufficiently mitigated. If the corrosion is not sufficiently mitigated, then the corrosion protection process flow 200 returns to block 215 (as shown by the NO arrow). The operations of decision block 220 can be considered a sensor feedback loop, where the corrosion prevention system 100 continuously checks a status of the apparatus 101 by polling the sensor and applies the negative potential via the electrical contact until the corrosion threat is gone.

If the moisture (or potential thereof) has been removed, then the corrosion protection process flow 200 proceeds to block 225 (as shown by the YES arrow). At block 225, the controller 110 causes/commands the power supply 105 to remove the negative potential from the metal of the apparatus 101.

Figure 3:
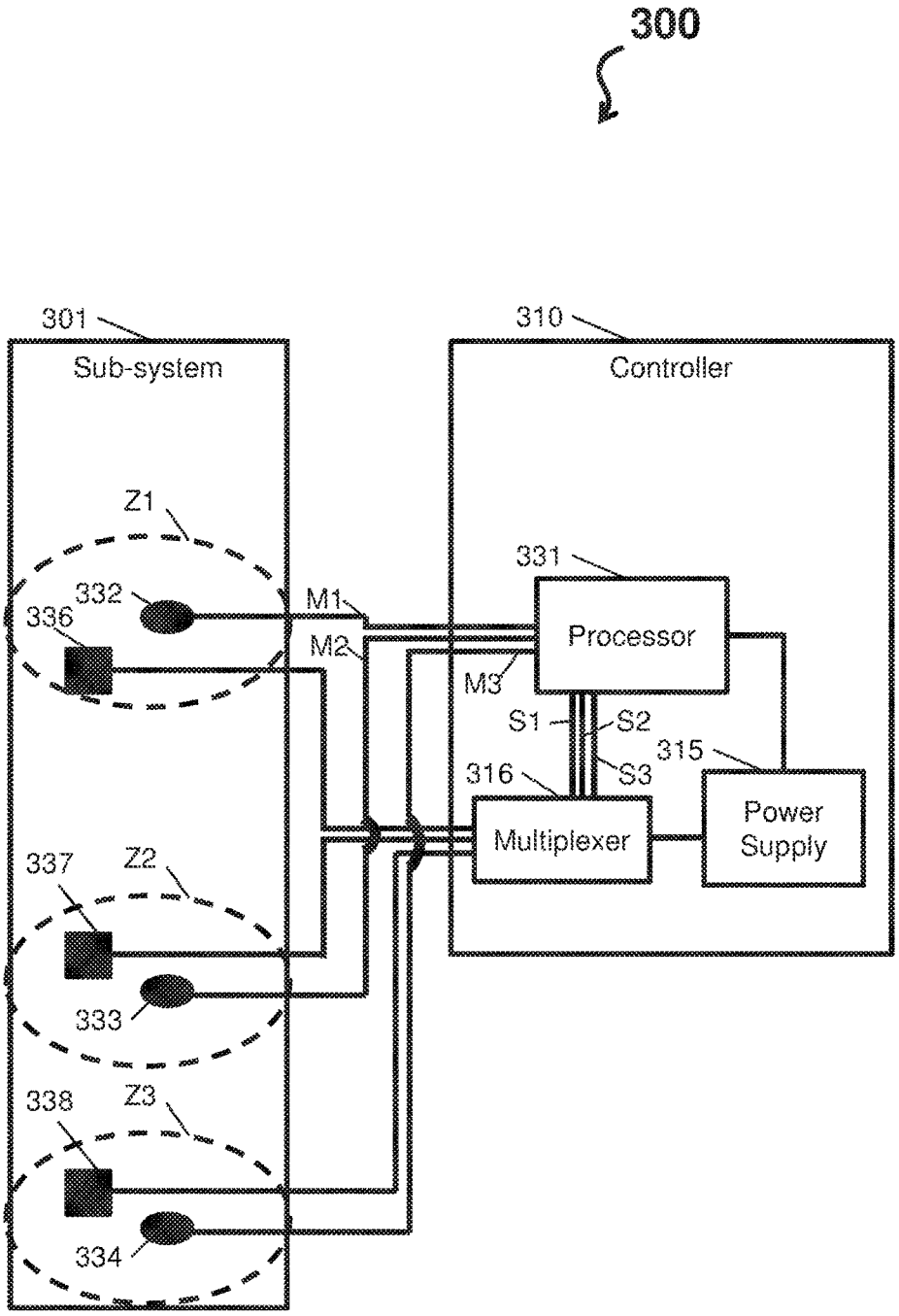
FIG. 3 depicts a corrosion protection system in accordance with one or more embodiments.

FIG. 3 depicts a corrosion protection system 300 in accordance with one or more embodiments. As depicted, the corrosion protection system 300 comprises a sub-system 301 and a controller 310. The sub-system can be any HVACR system or equipment described herein. The controller 310 can comprise a power supply 315, a multiplexer 316, and a processor 331. The controller 310 is electrically coupled to one or more sensors 332, 333, and 334 that respectively establish zones Z1, Z2, and Z3 within the sub-system 301. The corrosion protection system 300 utilize the zones Z1, Z2, and Z3 to identify and monitor portions of the sub-system 301.

The controller 110 is also electrically coupled to one or more electrodes 336, 337, and 338. The electrodes 336, 337, and 338 can be placed in locations throughout the sub-system 301 and/or further throughout the zones Z1, Z2, and Z3 themselves. In accordance with one or more embodiments, the electrodes 336, 337, and 338 can be placed in a pattern that optimizes corrosion prevention within the sub-system 301. The multiplexer 316 can be utilized to apply the negative potential from the power supply to one or more electrodes 336, 337, and 338. For example, based on the sensor signals M1, M2, and M3 received by the processor 331 of the controller 310, the processor 331 can apply one or more select signals S1, S2, and S3 (e.g., commands) to the multiplexer 316 to provide the negative potential from the power supply to one or more electrodes 336, 337, and 338.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A corrosion protection system comprising:

a controller electrically coupled to a sensor and a power supply;

wherein the sensor is operable to detect moister with respect to an apparatus;

wherein the power supply is electrically coupled to an electrical contact having a first electrode electrically coupled to an apparatus and a second electrode electrically coupled to the apparatus;

wherein the power supply is configured to control a first potential of the first electrode and a second potential of the second electrode such that a difference between the first potential and the second potential provides a negative potential difference to the apparatus in accordance with a command of the controller; and wherein the controller is operable to, based on receiving a sensor signal from the sensor, send the command the power supply to provide the negative potential difference through the first electrode and the second electrode to the apparatus; and wherein the sensor signal indicates a detection of the moisture.

2. The corrosion protection system of claim 1, wherein the negative potential difference comprises a potential that is more negative than if no potential is being applied, and wherein the negative potential difference mitigates, stops, or prevents corrosion of the apparatus when applied.

3. The corrosion protection system of claim 1, wherein the first electrode of the electrical contact and the second electrode of the electrical contact are coupled to a metallic component or portion thereof of the apparatus that is exposed to the moisture.

4. The corrosion protection system of claim 3, wherein the metallic component or portion thereof is selected from at least one member of a group consisting of tube header joints, rails of a box or container unit, and micro channel heat exchanger coils.

5. The corrosion protection system of claim 1, wherein the sensor comprises a corrosion sensor comprising a cathodic metallic layer and an anodic metallic layer, and wherein the cathodic metallic layer is configured to allow the moisture to pass therethrough.

6. The corrosion protection system of claim 1, wherein:

the first electrode of the electrical contact and the second electrode of the electrical contact are operable to provide the negative potential difference to the apparatus by completing a circuit with a metal of the apparatus such that the metal of the apparatus acts as a connecting resistor;

completing the circuit results in a current flow through the connecting resistor; and the current flow through the connecting resistor counteracts corrosion of the connecting resistor.

7. The corrosion protection system of claim 1, wherein the controller determines the negative potential difference required to mitigate corrosion due to the moisture.

8. The corrosion protection system of claim 1, wherein the controller regulates a direct current voltage from the power supply along range from 50 to 100 millivolts.

9. The corrosion protection system of claim 1, wherein the corrosion protection system comprises a sensor feedback loop that continuously checks a status of the apparatus by polling the sensor and applying the negative potential difference via the first electrode of the electrical contact and the second electrode of the electrical contact until a corrosion threat is gone.

10. The corrosion protection system of claim 1 further comprising:

multiple instances of the contact;

multiple instances of the sensor; and a multiplexer that provides the negative potential difference from the power supply to the multiple instances of the electrode;

wherein the controller is operable to apply one or more select signals to the multiplexer.

11. The corrosion protection system of claim 1 further comprising multiple instances of the electrode such that each of the multiple instances of the electrode establishes a zone within the apparatus.

12. A corrosion protection method comprising:

using a controller so send a command to a power supply;

wherein the controller is electrically coupled to a sensor and the power supply;

wherein the sensor is operable to detect moister with respect to an apparatus;

wherein the power supply is electrically coupled to an electrical contact having a first electrode electrically coupled to an apparatus and a second electrode electrically coupled to the apparatus;

wherein the power supply is configured to control a first potential of the first electrode and a second potential of the second electrode such that a difference between the first potential and the second potential provides a negative potential difference to the apparatus in accordance with the command of the controller; and using the controller to, based on receiving a sensor signal from the sensor, send the command the power supply to provide the negative potential difference through the first electrode and the second electrode to the apparatus;

wherein the sensor signal indicates a detection of the moisture.

13. The corrosion protection method of claim 12, wherein the negative potential difference comprises a potential that is more negative than if no potential is being applied, and wherein the negative potential difference mitigates, stops, or prevents corrosion of the apparatus when applied.

14. The corrosion protection method of claim 12, wherein the first electrode of the electrical contact and the second electrode of the electrical contact is coupled to a metallic component or portion thereof of the apparatus that is exposed to the moisture.

15. The corrosion protection method of claim 12, wherein the sensor comprises a corrosion sensor comprising a cathodic metallic layer and an anodic metallic layer, and wherein the cathodic metallic layer is configured to allow the moisture to pass therethrough.

16. The corrosion protection method of claim 12, wherein:

the first electrode of the electrical contact and the second electrode of the electrical contact are operable to provide the negative potential difference to the apparatus by completing a circuit with a metal of the apparatus such that the metal of the apparatus acts as a connecting resistor;

completing the circuit results in a current flow through the connecting resistor; and the current flow through the connecting resistor counteracts corrosion of the connecting resistor.

17. The corrosion protection method of claim 12, wherein the controller determines the negative potential difference required to mitigate corrosion due to the moisture.

18. The corrosion protection method of claim 12, wherein the controller regulates a direct current voltage from the power supply along range from 50 to 100 millivolts.

19. The corrosion protection method of claim 12, wherein the corrosion protection system comprises a sensor feedback loop that continuously checks a status of the apparatus by polling the sensor and applying the negative potential difference via the first electrode of the electrical contact and the second electrode of the electrical contact until a corrosion threat is gone.

20. The corrosion protection method of claim 12, wherein:

multiple instances of the electrode are provided; and the corrosion protection method further comprises applying a select signal to a multiplexer of the controller to provide instances of the negative potential difference to the multiple instance of the electrode.

* * * * *